United States Patent [19]

Chambert

[11] Patent Number: 5,060,599

[45] Date of Patent: Oct. 29, 1991

[54] METHOD AND REACTOR FOR COMBUSTION IN A FLUIDIZED BED

[75] Inventor: Lars A. Chambert, Bjärred, Sweden

[73] Assignee: Götaverken Energy Aktiebolag, Göteborg, Sweden

[21] Appl. No.: 476,460

[22] PCT Filed: Dec. 14, 1987

[86] PCT No.: PCT/SE87/00601

§ 371 Date: Aug. 7, 1990

§ 102(e) Date: Aug. 7, 1990

[87] PCT Pub. No.: WO89/05942

PCT Pub. Date: Jun. 29, 1989

[30] Foreign Application Priority Data

Jun. 12, 1986 [SE] Sweden ..... 8602631

[51] Int. Cl.[5] ..... B09B 3/00; F22B 1/00

[52] U.S. Cl. ..... 122/4 D; 110/245; 165/104.16

[58] Field of Search ..... 122/4 D; 165/104.16; 110/245, 347

[56] References Cited

U.S. PATENT DOCUMENTS

| | | | |
|---|---|---|---|
| 4,672,918 | 6/1987 | Engstrom et al. | 122/4 D |
| 4,709,663 | 12/1987 | Larson et al. | 122/4 D |
| 4,745,884 | 5/1988 | Coulthard | 122/4 D |
| 4,777,889 | 10/1988 | Smith | 122/4 D X |
| 4,813,479 | 3/1989 | Wahlgren | 165/104.16 |
| 4,823,740 | 4/1989 | Oashita et al. | 122/4 D |

*Primary Examiner*—Edward G. Favors

*Attorney, Agent, or Firm*—Birch, Stewart, Kolasch & Birch

[57] ABSTRACT

A method and a reactor for combustion of solid granular fuel material in a fluid bed by means of primary air supplied to the bottom of said reactor and by secondary air supplied a distance above the reactor bottom, solid granular fuel material which is falling along the boundary side wall of the reactor being collected in at least one pocket arranged in the direction in which the material is falling, a cooling surface being arranged in said pocket.

16 Claims, 3 Drawing Sheets

METHOD AND REACTOR FOR COMBUSTION IN A FLUIDIZED BED

BACKGROUND OF THE INVENTION

Systems for generating steam or so-called steam-generating boilers based on a reactor for so-called "quick-circulating" fluidization are known from commercial constructions. "Fast" fluidization occurs in a flow of combustion gases and air directed almost vertically upward, in which a granular material is carried and substantially entrained upward by the gas. This material consists of a fuel, e.g. coal and ash products from coal having, if necessary, an admixture of limestone for absorption of sulphur or an inert material such as sand. In most cases, the rate of flow is 3–8 m/s, and the size of the flowing grains is extremely small, i.e. in the micrometer range, up to some millimeter. The quantity of solid material may vary from low values at low load, up to twenty or more kg/m$^3$ at high load.

Most of the entrained solid material is separated in a particle separator—for example a cyclone type separator—when flowing out from the top of the reactor and is "circulated" to the lower part of the reactor so as to:

a) maintain a suitable material density and sojourn time in the reactor, b) obtain an excellent combustion reaction, and c) obtain an excellent reaction of absorption for e.g. sulphur separation with an admixture of limestone.

Such a reactor is shown in FIG. 1.

The reactor is further characterized in that mainly by introduction of primary air into the bottom part and secondary air at a suitable level thereabove, a situation is, in practice, established in which a lower speed is obtained in the bottom part and a higher speed thereabove, which inter alia gives a higher density of solid material in the bottom part (in many cases from 100 to 600 kg/m$^3$), where fuel can be degassed and partly burned. Large fuel particles and other solid materials stay or are enriched in this zone until they are burned out completely or disappear through a special material outlet in the bottom part. In operation, the reaction temperature is 750°–1000° C., however preferably 825°–900° C. in the combustion of coal.

To cool the system and recover the required part of the developed power of combustion, two techniques are used today. One implies that cooled surfaces, for example vertical tube surfaces cooled by water or steam, are arranged on the walls of the reactor or as internal baffles or the like disposed in the reactor. The other technique which is sometimes also combined with the first, implies that further power outputs are provided in that the flow of particles which is separated in said particle separator at the top of the reactor is wholly or partly conducted to an ash cooler of some suitable type before being reintroduced into the reactor. Of course, the power output is determined also by the amount of hot gas which is leaving the reactor.

Technically seen, there now is a situation where a first combustion reaction occurs in the bottom part of the reactor having the above-mentioned higher density of solid material, whereupon the final combustion of gases expelled from the fuel and burning-out of the coke particles formed occur higher up where the oxygen content has been increased by addition of secondary air.

For different reasons, it is not suitable to arrange heat-absorbing metallic surfaces in the bottom part of the reactor. One reason is the low oxygen partial pressure which easily causes corrosion on metallic surfaces and/or erosion.

The absorption of heat on cooling surfaces arranged on the reactor walls occurs through radiation from particles and gas supplemented with convective gas cooling towards the wall and more or less direct particle contact, whereby also large amounts of heat can be transferred. At full load, the heat transfer is typically between about 140° and about 250 W/m$^2$ °C. depending on the temperature and the current particle load, when an optimal combustion of coal is desired.

In large reactors, it is constructionally difficult to arrange a sufficient cooling surface in the walls only, if the reactor is not made extremely high. Normally it is not considered economically optimal to make the reactor higher than required for a favourable combustion reaction. For this reason, the above-mentioned techniques of arranging cooling surfaces inside the reactor or of cooling the ashes before being reintroduced into the reactor, are used as a complement.

To obtain an optimal combustion reaction and absorption of sulphur, it must be possible to control a reactor of the above-mentioned type such that combustion of e.g. coal takes place in a relatively narrow range of temperature of about 850°–875° C. at full load and partial load. It has become apparent that natural parameters to be influenced are 1) the total contents of solid material in the reactor, 2) the part of this material, which is kept floating (i.e. the load of material) in the upper part with its cooling surfaces (which directly affects the coefficient of heat transfer), 3) the distribution of grains of the solid material (where a high amount of fine grains yields high coefficients of heat transfer), 4) recirculation of colder combustion gases (which increases the amount of heat carried away from the reactor by the gases) and 5) more or less cooling of the solid material which is separated after the reactor before this material is recycled.

Generally seen, it is known that such a reactor is to a certain extent self-adjusting, since if the flows of air to the bottom zone vary according to the load, the amount of material which is kept floating by the gas and, thus, the absorption of heat increase or decrease.

In constructional respect, the problems of obtaining an adequate position of the cooling surfaces increase according to the size of the reactor and the steam data (pressure and temperature) which the steam generator is to generate. Cooling surfaces such as tubes or bundles of tubes which are disposed inside the reactor are readily subjected to erosion under the action of the high flow of solid particles. Coolers for material separated in e.g. a cyclone are bulky, expensive and difficult to locate in large installations. In fact, they are units that require a very large space at the side of the reactor, and in addition to this, there are designing problems with ducts and the handling of high flows of material which are to be introduced into and discharged from the reactor.

BRIEF DESCRIPTION OF THE INVENTION

The present invention which uses the basic principle of the type of reactor described above, aims at better controlling the problems with erosion etc. and further safely providing high steam data—i.e. extremely high pressures and temperatures—and also very large combustion units by means of a suitable module design.

This is achieved by a method and a reactor according to the claims.

The invention is based on observations which have been made of the real function of the prior art reactor described above.

The described upward flow of solid material along with the gas is not uniform over the cross-section of the reactor. There are wall effects that can be described such that the density or amount of solid material increases adjacent the walls where the particles are easily decelerated. This means that a certain amount of material is falling down in this zone. This amount of material either falls all the way or is decelerated and is again entrained upward by the gases. The sum of the movement is, however, a certain downward flow adjacent the walls. Similar effects are produced when the reactor cross-section etc. is changed, and interfere with the flow.

The invention is based on the condition that this type of effects is used and possibly intensified by a special design of the reactor, and that the material falling down in said border zone is collected and cooled by means of special cooling surfaces, before the solid material is again admixed to the reactor,

BRIEF DESCRIPTION OF THE DRAWINGS

Embodiments of the present invention will now be described in detail with reference to the accompanying schematic drawings.

Figure 1:
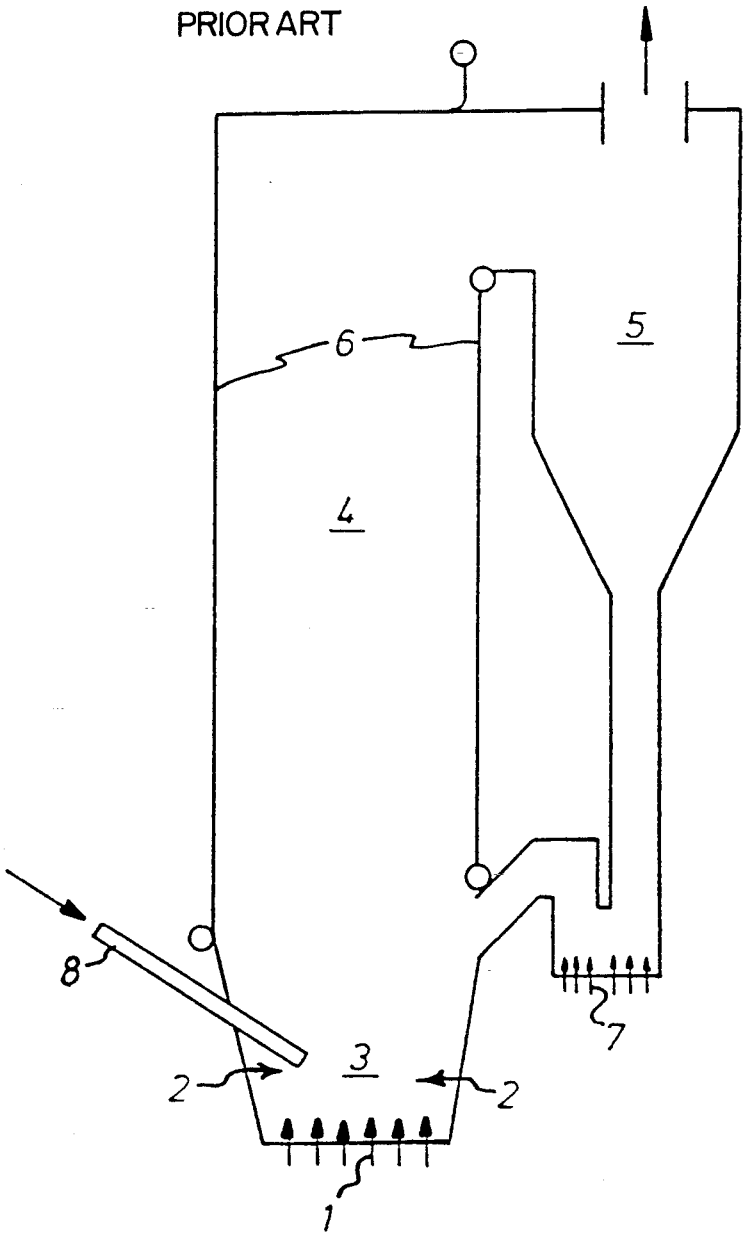
Fig.1 PRIOR ART
FIG. 1 shows, as already mentioned, a conventional reactor.

Each reference numeral in the Figures refers to one and the same item.

DETAILED DESCRIPTION OF A PREFERRED EMBODIMENT

FIG. 1 illustrates primary air 1 to the bottom zone, secondary air 2 to the upper part of the bottom zone, a zone 3 with a relatively high density of material in the fluid bed, an upper part 4 of the reactor with a low density of material, a cyclone or separator 5, cooling surfaces 6, "lifting air" 7 for recirculation of material and fuel supply 8.

Figure 2:
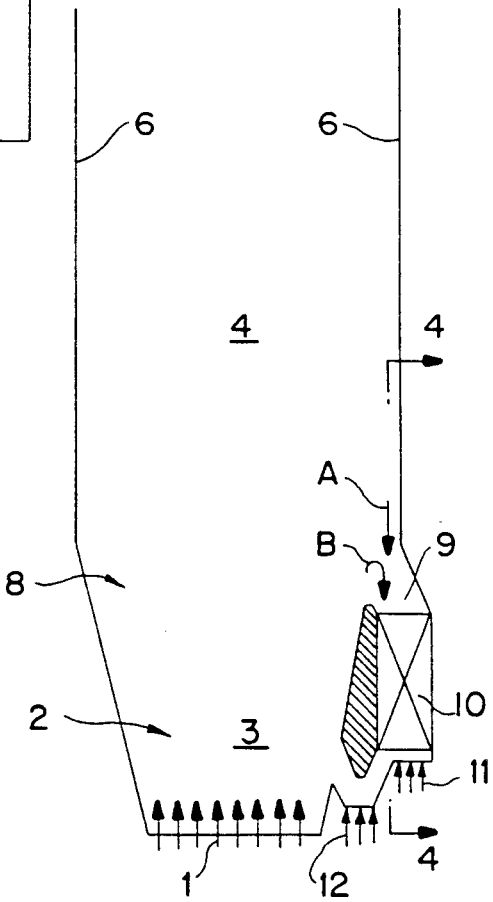

FIG. 2 shows a pocket 9 in the reactor wall, a cooling surface 10 in the pocket, fluidizing air 11, control air 12 for controlling material.

FIG. 2 illustrates how a pocket is formed in a simple way in the lower part of the reactor so as to collect falling solid material which is received from said zone adjacent the walls (arrow A) and through the interference which the pocket itself causes in the flow in the reactor (arrow B).

The upward opening of the pocket is located on a level which is not lower than close to the level of the secondary air supply and preferably lies in a reactor region in which the density of the fluidized bed is considerably lower than adjacent the reactor bottom. The level of the secondary air supply can be 0.4–4 m, and one usually operates with rates of flow of 2–10 m/s, whereby an upwardly decreasing material load in the of 3–30 kg/m$^3$ is obtained, with preferably fine-range grained material in the upper part of the reactor.

Several such pockets can be arranged in the reactor.

Figure 3:
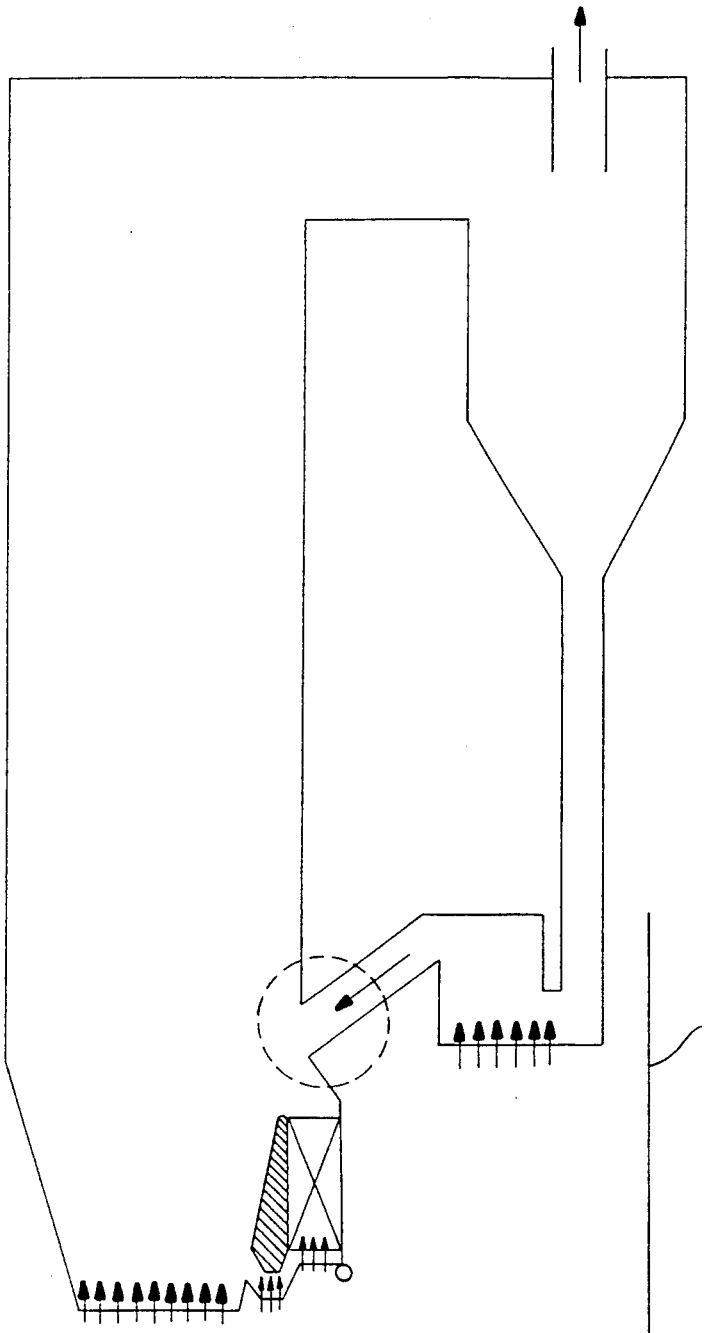
FIGS. 2 and 3 show essential parts of a reactor according to the invention.

The quantity of material cooled in such a pocket can be increased in that material which has been separated in a particle separator—like the above described cyclone on the top of the reactor—is recycled to the reactor in a region close above the upper parts of said pocket or directly into these upper parts, see FIG. 3, where the encircled area above the pocket contains an inlet for recirculated solid material. Thus, the return material easily falls down into the pocket.

These arrangements bring the advantage appearing from FIGS. 2 and 3, and thus, an optional cooling surface for steam, water or some other medium can readily be arranged in the pocket. The cooling surface can be formed of, for example, a tube arrangement. An excellent heat absorption is obtained in that the material in the pocket, preferably fine, relatively burned-out material—is fluidized by means of a suitable flow of air through nozzles, holes or the like in the bottom of the pocket, the rate of flow preferably being 0.4–1.5 m/s.

By a constructionally simple measure as forming a pocket, the invention thus allows the arrangement of a heat-absorbing auxiliary surface within substantially corresponding normal horizontal cross-sections in the upper parts of the reactor, whereby sufficient heat absorption will be obtained. Of course, the fluidizing air in the pocket participates in the combustion process of the reactor and thus is used in the boiler process.

For optimal function, the quantity of material transformed in the pocket needs to be controlled. The easiest way is, of course, to let falling material entering from above be balanced by a corresponding outflow over the edge of the pocket. However, as an alternative a duct or opening in the bottom of the pocket can discharge material downward—or in a lateral direction. This can occur such that control air or gas is let into the duct, whereby the flow of solid material is either increased or even caused to stop. See FIG. 3.

To achieve optimal control and utilization of the construction materials which are available for e.g. superheaters, the heat load or heat absorption by tubes must in certain cases be restricted to give them a sufficiently long life. In a fluid bed, the heat absorption (the coefficients of heat transfer) is in many cases high, particularly with fine-grained material. In typical cases, 400°–700 m/m$^2$ ° C. can be produced. The technique which is then available to restrict the load is reducing the temperature level. In this case, this can be carried out in that the above pocket with its cooling surface is made relatively deep and is provided with a bank of closely arranged tubes or a cooling surface preventing any appreciable vertical mixing. In addition, the flowing through of material can be limited by the flow control mentioned above.

Figure 4:
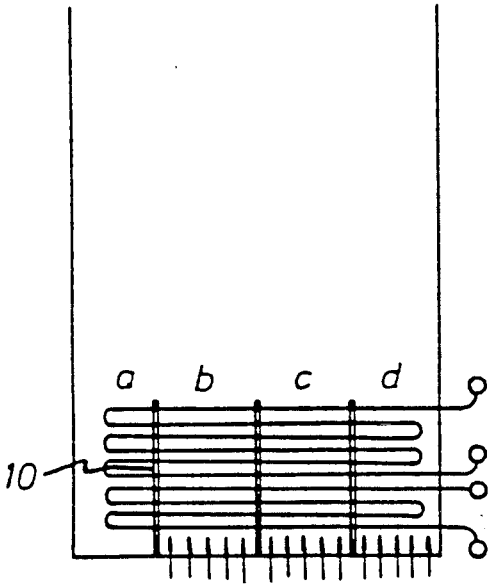
FIG. 4 is a cross-sectional view along line 4—4 in FIG. 2.

Part of the invention thus is the possibility of reducing the temperature of the material in the lower parts of the pocket by e.g. 50°–200° C., by a suitable design of the pocket and the cooling surface and by controlling the flow of material. FIG. 4 is a cross-sectional view of the pocket in FIG. 2 which has been divided into four zones a–d that can be fluidized separately. The number of zones can, of course, be varied.

There are also other principles for controlling the heat absorption. One of the simplest principles is defluidization of parts of a fluid bed. If required, this principle can be easily applied in a pocket having a cooling surface as described.

Figure 5:
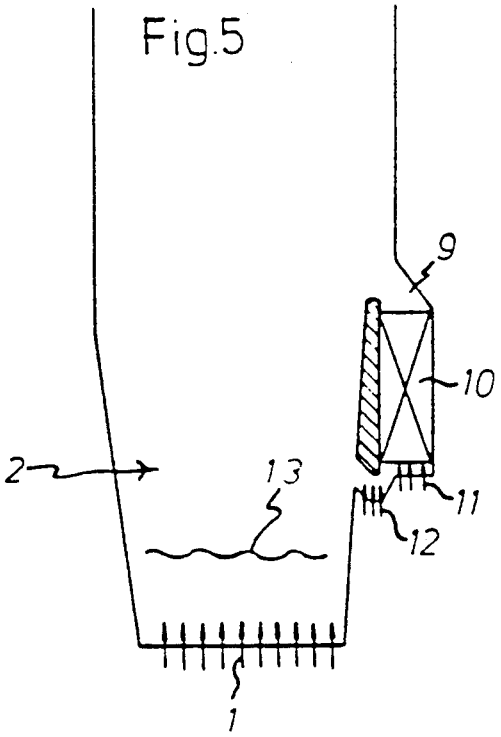
FIG. 5 illustrates a further variant of the reactor according to the invention.

For optimal safety, a cooling surface in a fluid bed must, upon cessation of the load, be passed by a suitable cooling medium, or the bed must be emptied of the hot solid material so as to avoid overheating. In this case, it is possible to arrange the pocket, see FIG. 5, at such a high level above the bottom that after stoppage, the material in the pocket can be emptied in a relatively simple manner into the bottom zone of the reactor. This is based on the condition that the solid material in the reactor usually corresponds to a quantity of material, the height of which is lower than one meter from the reactor bottom. It is then easy to design the pocket such that its contents of solid material can be emptied over the remaining material 13 in the reactor bottom upon cessation of the load. This is preferably carried out by means of the pocket control air.

The invention includes several other constructional possibilities and facilitates for example the load of material in the reactor being reduced to the level which is required only for an adequate function of the combustion and a suitable vertical temperature gradient. The heat absorption in the side walls needs no longer be optimized by a relatively high load of material in the reactor. The pressure drops will be relatively low.

Figure 6:
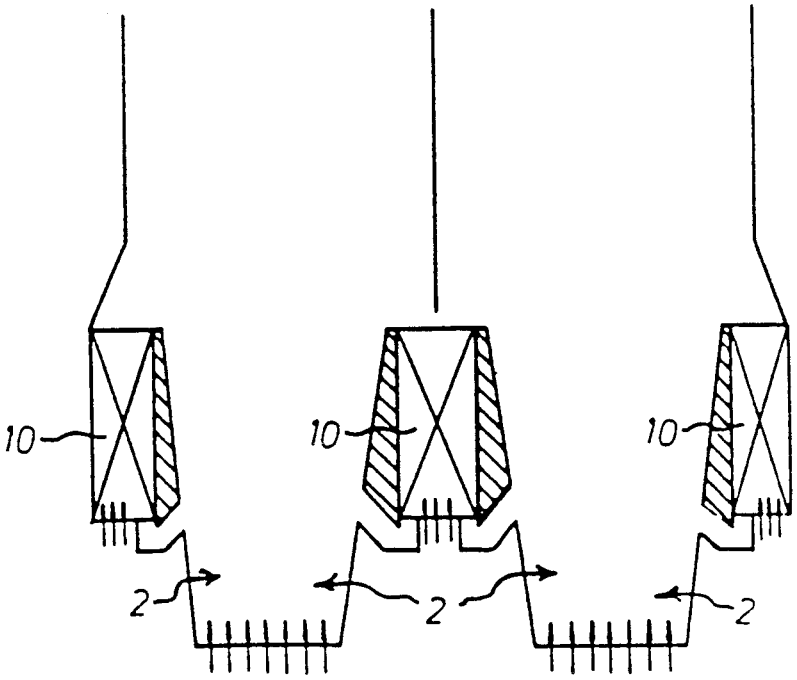
FIG. 6 shows a larger reactor.

In large installations, it is possible to combine several reactors located side by side—see FIG. 6.

When a suitable fuel admixture is obtained in the bottom zone, the combustion and the gas analysis will be uniform over the reactor cross-section in high reactors.

In large installations, it will then be possible to obtain an optimally inexpensive structure by eliminating the cyclone function which is normal in the context and by replacing it by a "particle trap" arranged in the reactor outlet, the particle trap being of, for example, a per se known type which through e.g. deflections of the gas flow separates a sufficient quantity of solid material and returns it to the reactor. As a result, the output gas will not be too erosive for transverse tube banks or other elements arranged after the reactor.

I claim:

1. A reactor for combustion of solid granular fuel material in a fluid bed comprising:

a fluid bed;

a reactor bottom;

boundary side walls;

means for supplying primary air to said reactor bottom; and means for supplying secondary air at a distance above said reactor bottom, said primary and secondary air dividing said fluid bed in the reactor into a dense primary bed and a less dense secondary bed;

said reactor having one or more pockets within said boundary side walls, said pockets having upward mouths located not lower than a level of said secondary air supply, and said pocket having a cooling surface arranged therein.

2. The reactor of claim 1, wherein said pocket is provided with a bottom which is connected with a main volume of the reactor by means of a duct which has an inlet for control air.

3. The reactor of claim 1 or 2, further comprising a solid material separator arranged in a gas outlet and adapted to provide deflection of output gas in one or more directions substantially horizontally, said solid material separator comprising a duct adapted to guide separated solid material downward and back to the reactor.

4. The reactor of claim 1 or 2, further comprising a plurality of said reactors arranged adjacent one another, one or more pockets and cooling surfaces being arranged between each pair of two adjacent reactors and being used in common by each of the two reactors.

5. A method for combustion of solid granular fuel material in a reactor having a fluid bed, a reactor bottom, and boundary side walls, the method comprising the steps:

(1) supplying primary air to the reactor bottom;

(2) supplying secondary air at a distance above the reactor bottom, said primary air and said secondary air dividing the fluid bed of said reactor into a dense primary bed and a less dense secondary bed;

(3) providing at least one pocket in said boundary side walls of said reactor;

(4) providing a cooling surface formed in said pocket;

(5) collecting in said pocket any solid granular fuel material which is falling down in said secondary bed adjacent and within said boundary side walls, collection taking place not lower than a level of said secondary air supply, said pocket having an upward opening arranged in a direction in which said solid granular fuel material is falling; and (6) conducting away by said cooling surface any heat collected in said solid granular fuel material which collects in said pocket.

6. A method as claimed in claim 5, further comprising the steps:

(1) providing said reactor with a cyclone or other separating means;

(2) separating wholly or partly burned solid fuel material in said cyclone; and (3) recycling said wholly or partly burned solid fuel material back to said reactor above said pocket, such that at least to some extent said wholly or partly burned fuel material is collected in said pocket and cooled therein by said cooling surface.

7. A method as claimed in claim 5 or 6, further comprising the step of supplying fluidizing air through a bottom of said pocket such that the solid fuel material which collects in said pocket is fluidized.

8. A method as claimed in claim 5 or 6, further comprising the steps of:

(1) providing a duct or opening in the bottom of said pocket;

(2) supplying a flow of control air at the duct or opening in the pocket bottom such that the collected solid fuel material can be discharged from the pocket through the duct or opening; and (3) said flow of control air to reintroduce the discharged solid fuel material into the fluid bed.

9. A method as claimed in claim 7, further comprising the step of controlling an amount of heat absorbed by the pocket cooling surface by forming the cooling surface such that vertical mixing of the fluidized fuel mixture in the pocket is obstructed, thereby obtaining a temperature gradient from the upward opening of the pocket to the bottom of the pocket.

10. A method as claimed in claim 7, further comprising the step of controlling an amount of heat absorbed by the pocket cooling surface by defluidizing a major or minor part of the cross-section of the pocket.

11. A method as claimed in claim 5 or 6, further comprising the step of protecting the pocket cooling surface in case of a sudden service interruption by emptying the pocket of solid fuel material through its bottom.

12. A method as claimed in claim 7, wherein said slid material in the pocket is fluidized at a rate of between 0.4 and 1.5 m/s.

13. A method as claimed in claim 5 or 6, wherein the secondary air is supplied 0.4–4 m above the reactor bottom, a flowing rat of the secondary air is selected in a range of 2–10 m/s, and a load of solid material in the secondary bed is selected in a range of 3-kg/m$^3$.

14. A method for combustion of solid granular fuel material in a reactor having a fluid bed, a reactor bottom, and boundary side walls, the method comprising the steps:

(1) supplying primary air to the reactor bottom;

(2) supplying secondary air at a distance above the reactor bottom, said primary air and said secondary air dividing the fluid bed of said reactor into a dense primary bed and a less dense secondary bed;

(3) providing at least one pocket in said boundary side walls of said reactor;

(4) providing a cooling surface formed in said pocket;

(5) collecting in said pocket any solid granular fuel material which is falling down in said secondary bed adjacent and within said boundary side walls, collection taking place not lower than a level of said secondary air supply, said pocket having an upward opening arranged in a direction in which said slid granular fuel material is falling;

(6) conducting away by said cooling surface any heat collected in said solid granular fuel material which collects in said pocket;

(7) discharging solid fuel material from said pocket through a bottom of said pocket and reintroducing said solid fuel material into the fluid bed in a controlled manner; and (8) protecting said pocket in case of a sudden service interruption by emptying said solid material through the pocket bottom into the fluid bed resting on the reactor bottom.

15. A reactor for combustion of solid granular fuel material in a fluid bed comprising:

a fluid bed;

a reactor bottom;

boundary side walls;

means for supplying primary air to said reactor bottom; and means for supplying secondary air at a distance above said reactor bottom, said primary and secondary air dividing said fluid bed in the reactor into a dense primary bed and a less dense secondary bed, said reactor having one or more pockets within said boundary sidewalls, said pockets having upward mouths located not lower than a level of said secondary air supply, and said pocket(s) having a cooling surface arranged therein;

the reactor further comprising means for discharging solid fuel material from the pocket, said pocket being arranged at a high level above the reactor bottom such that the solid fuel material collected in the pocket can be emptied on the reactor bottom.

16. The reactor of claim 15, wherein said pocket is provided with a bottom which is connected with a main volume of the reactor by means of a duct which has an outlet for control air for said discharging and emptying.

* * * * *